United States Patent [19]

Endter

[11] 4,272,981

[45] Jun. 16, 1981

[54] WORKPIECE MANIPULATOR FOR FORGING PRESS

[75] Inventor: Horst Endter, Düsseldorf, Fed. Rep. of Germany

[73] Assignee: Maschinenfabrik Hasenclever Gesellschaft mit beschränkter Haftung, Düsseldorf, Fed. Rep. of Germany

[21] Appl. No.: 12,515

[22] Filed: Feb. 15, 1979

[30] Foreign Application Priority Data

Feb. 18, 1978 [DE] Fed. Rep. of Germany ..... 2806987

[51] Int. Cl.[3] ..... B21D 43/05

[52] U.S. Cl. ..... 72/405; 72/421

[58] Field of Search ..... 72/361, 405, 421, 419

[56] References Cited

U.S. PATENT DOCUMENTS

| | | | |
|---|---|---|---|
| 4,012,937 | 3/1977 | Imanishi | 72/421 |
| 4,024,749 | 5/1977 | Taniguchi | 72/421 |

FOREIGN PATENT DOCUMENTS 2613269 10/1976 Fed. Rep. of Germany .

*Primary Examiner*—Charlie T. Moon
*Assistant Examiner*—Gene P. Crosby
*Attorney, Agent, or Firm*—Karl F. Ross

[57] ABSTRACT

A workpiece manipulator has a first epicyclic-gear transmission having a rotary input and a crank output which moves generally in a planar and rectangular path on rotation of the rotary input through a predetermined angular distance. This path has generally parallel upright sides and generally parallel top and bottom sides interconnecting the upright sides. A drive including another epicyclic-gear train is connected to this rotary input and rotates same at a speed increasing generally from a standstill to a predetermined speed then slowing generally to a standstill again twice for each travel of the output about the rectangular path. These standstills correspond respectively to intermediate positions of the crank output along the upright sides of the path. A workpiece holder is connected through an upright threaded spindle to the crank output for joint displacement of the holder and the crank output during travel of this output along the top and bottom sides of the path and during travel along those portions of the upright sides of the path below the intermediate positions thereon, and for displacement of the holder in a direction generally perpendicular to the plane of the upright sides during travel of the output along the portions of the upright side above the intermediate positions thereon. All displacement rates increase and decrease sinusoidally so that the holder can enter and stop in a pressing station of a forging press, for example, then pick up a workpiece and move to the next station. Thereafter the holder lowers, then stops and releases the workpiece, and finally withdraws.

7 Claims, 7 Drawing Figures

WORKPIECE MANIPULATOR FOR FORGING PRESS

FIELD OF THE INVENTION

The present invention relates to a workpiece manipulator for use in a forging press or the like. More particularly this invention concerns such a manipulator which automatically steps a workpiece through several working stations of such a press.

BACKGROUND OF THE INVENTION

A forging press frequently has a plurality of pressing stations. A workpiece blank is loaded into the upstream pressing station, pressed, and then sequentially displaced through the downstream stations after each subsequent pressing operation. In this manner it is possible for a single forging press having three pressing stages to produce a finished workpiece with each operation, even though each workpiece must be forged three separate times.

Thus, it is known to provide a number of manipulators, holders, or tongs one less than the number of stations, and to provide mechanism capable of moving them in two orthogonal directions. Such mechanism normally simply includes a set of hydraulic cylinders connected to a carriage carrying the holders or tongs in the pressing room after the die has been lifted so that the tongs can grip the workpieces, then lift the carriage to lift the workpieces, and then displace the carriage along to the next station whereupon the workpieces are lowered and released. Finally the carriage is stepped back to its original position for carrying out of another such stepping cycle.

Such an arrangement has considerable disadvantage, the particular one being that the displacement of the tongs is relatively brusque, starting and stopping rapidly. It has been suggested to overcome this in part by means of epicyclic gearing of the type disclosed in German patent publication 2,613,269. Such an arrangement falls, far short of providing a smoothly working system with a long service life.

More particularly the known manipulators of the above-described general type have the considerable disadvantage that they have an excessive number of independently working parts. Any loss of synchronism of the parts can result in damage to the workpiece, manipulator, or press. It is also very difficult to establish just the right synchronisation between the operation of the various cylinders or motors that actuate the system.

Another disadvantage with most of the prior art systems is that the tongs remain within the press during the pressing operation. This considerably reduces the pressing area available.

OBJECTS OF THE INVENTION

It is therefore an object of the present invention to provide an improved manipulator.

Another object is to provide such a manipulator which moves completely out of the press when not displacing a workpiece.

Another object is to provide such a manipulator wherein synchronous operation of its various functions is ensured.

A further object is to provide a manipulator which gently yet surely handles the workpiece.

SUMMARY OF THE INVENTION

These objects are attained according to the instant invention in a workpiece manipulator having a first transmission means with a rotary input and a crank output. This output moves generally in a planar and rectangular path on rotation of the rotary input through a predetermined angular distance, normally one revolution. The path has generally parallel first and second sides and generally parallel third and fourth sides interconnecting the first and second sides and forming a plane therewith. Drive means is connected to this rotary input and rotates same at a speed increasing generally from a standstill to a predetermined speed then slowing generally to a standstill twice for each travel of the output about the rectangular path. These standstills respectively correspond to intermediate positions of the output along the first and second slides. A workpiece holder is connected via a second transmission means to the output of the first transmission means for joint codirectional displacement of this holder and the output during travel of the output along the third and fourth sides of the path and during travel of those portions of the first and second sides between the third side and the intermediate positions. This second transmission means also serves to displace the holder in a direction generally perpendicular to the plane of the sides of the path during travel of the output along those portions of the first and second sides between the fourth side and the intermediate positions. More particularly the first and second transmissions include respective first and second epicyclic gear trains so that all speeds increase and decrease sinusoidally. The holders are capable of opening and closing and therefore move gently to a stop around the workpiece, close then gently left and accelerate away with the workpiece. The same gentle stopping and starting is obtained when the workpiece is deposited in the next working station.

In accordance with yet another feature of this invention the first and second sides are vertical whereas the third and fourth sides are horizontal. The crank output is connected via a lever to a traversing carriage that generally follows the displacement in the above-described plane of the crank output. This traversing carriage threadedly engages an upright spindle having an upper end fixed in a lift carriage that therefore is jointly horizontally displaced with the traversing carriage but which can move vertically relative thereto rotate the spindle. The holder is mounted on a holder carriage which can move horizontally in the third direction relative to the lift carriage, but otherwise moves jointly codirectionally therewith. The spindle carries at its upper end a pinion that engages in a rack of this holding carriage. Means is provided for preventing the lift carriage from moving jointly in the first upright direction during displacement of the crank output between the intermediate positions and the fourth side for screwing of the spindle in the traversing carriage to rotate the pinion and displace the holder carriage in the third horizontal direction. This means merely comprises guide rails which engage the underside of the lift carriage when same moves down into the intermediate positions. Hence in effect the rectangular path of the crank output is folded at these intermediate locations by the spindle.

Once such an arrangement is set up, perfectly synchronous operation is ensured at all times. It is impossible for the various movements to go out of synchronization, as only relative displacement of the positively meshing teeth of the gears would permit this and this would only be possible if the system were seriously damaged. As a result the system is relatively foolproof in operation and can be counted on to perform the relatively complex series of movements described above at all times. What is more the use of epicyclic gearing ensures that wear will be minimized, as nothing is brought to a sudden halt but instead gradually slows to such a halt and gradually accelerates after such a halt. The use of complex control means ensuring synchronization of the various parts, required in all prior-art systems, can be almost completely eliminated. A single drive motor controls all operations, so merely setting its speed relative to the cycling speed of the forging press ensures perfectly synchronous operation at all times.

SPECIFIC DESCRIPTION

Figure 1:
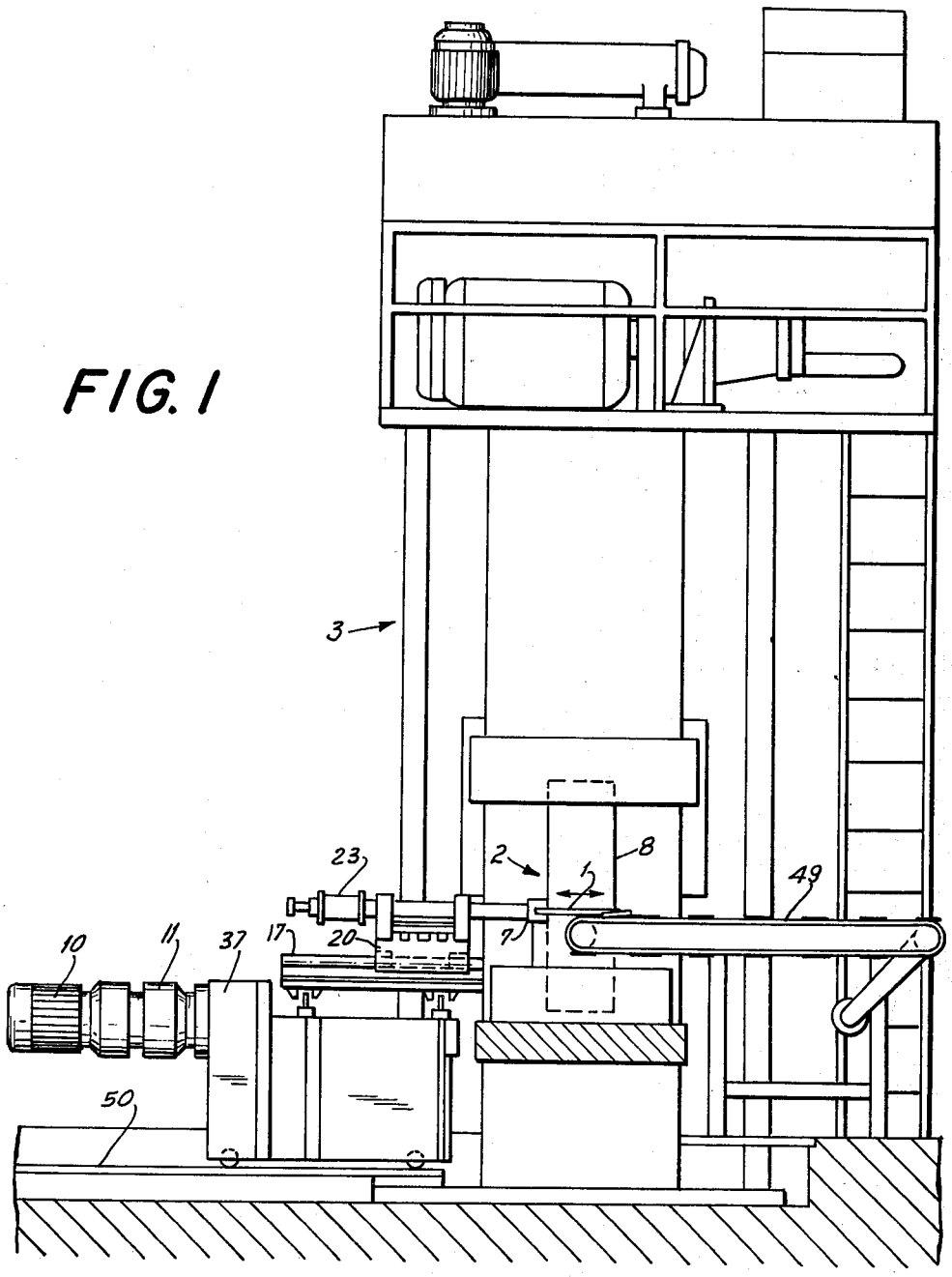
FIG. 1 is a side view of the apparatus according to the instant invention.

As shown in FIG. 1 the apparatus according to this invention has a housing 37 adapted to stand next to a forging press 3 and to displace workpieces 1 through it. These workpieces 1 are loaded in by a conveyor-type loading mechanism 49, and are stepped through four pressing or forging stations 2 each associated with a respective tool 8 by means of three pairs of manipulator tongs 7. The entire housing 37 of the device can roll via wheels on rails 50 relative to the press 3. A large electric motor 10 powers the device through a transmission 11.

Figure 2:
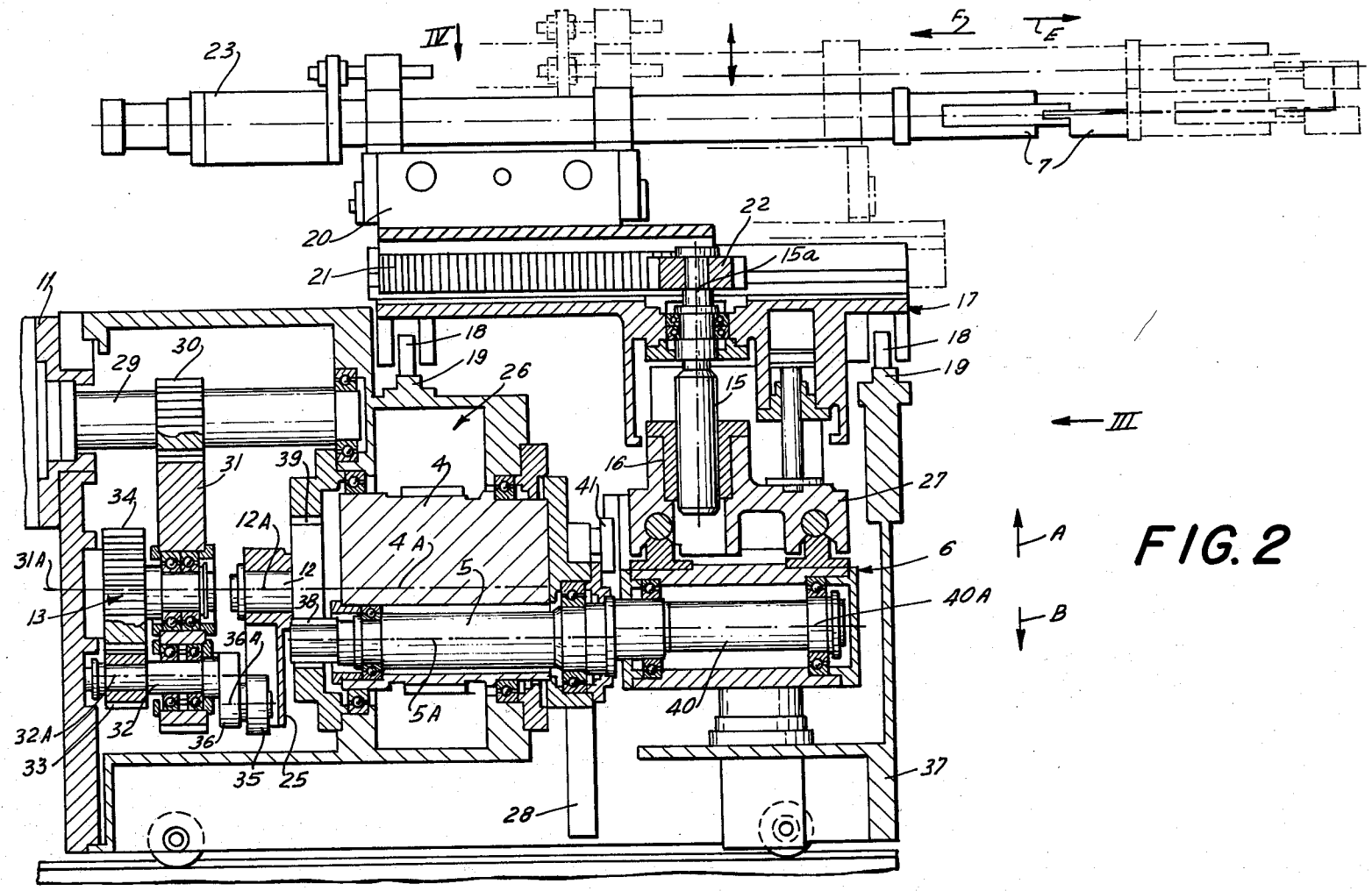
FIG. 2 is a large-scale vertical section through the manipulator according to the instant invention.
Figure 3:
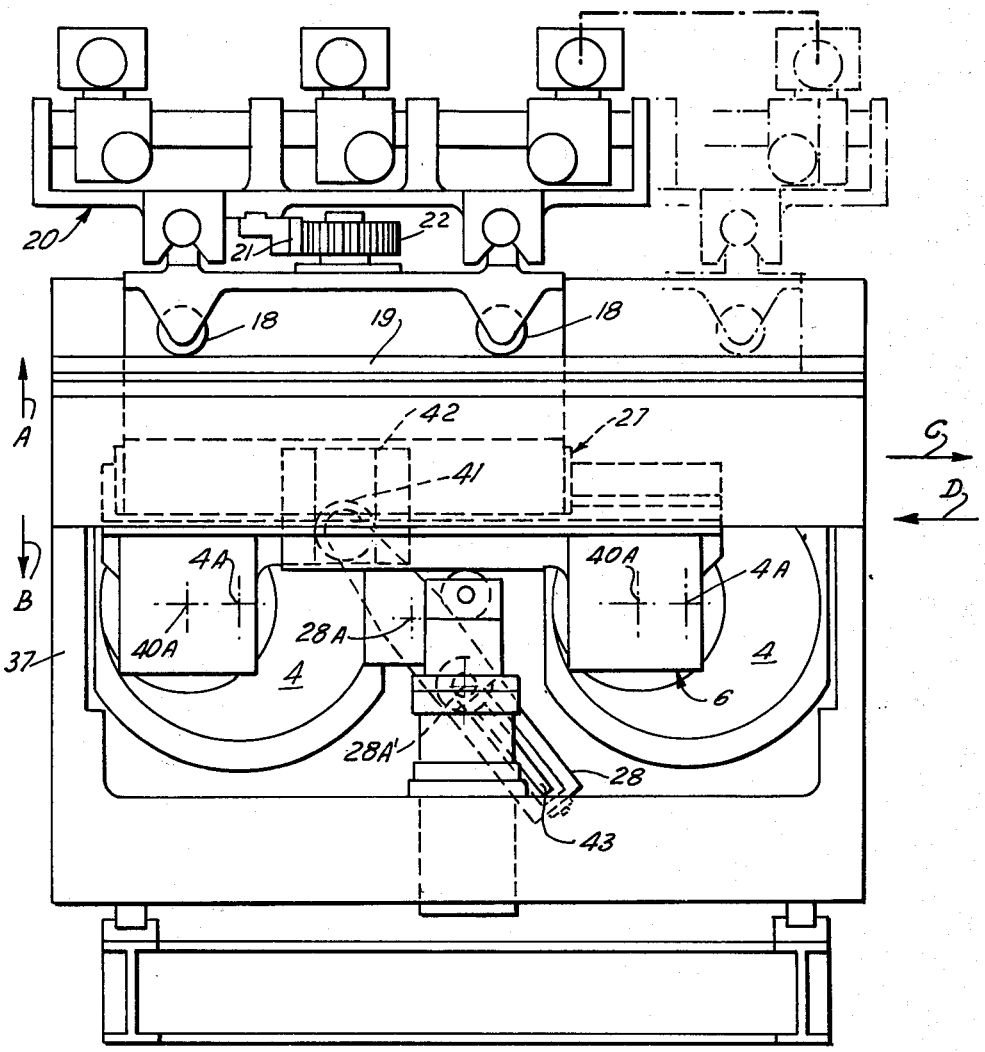
FIGS. 3 and 4 are respectively views taken in the direction of arrows III and IV of FIG. 2.
Figure 4:
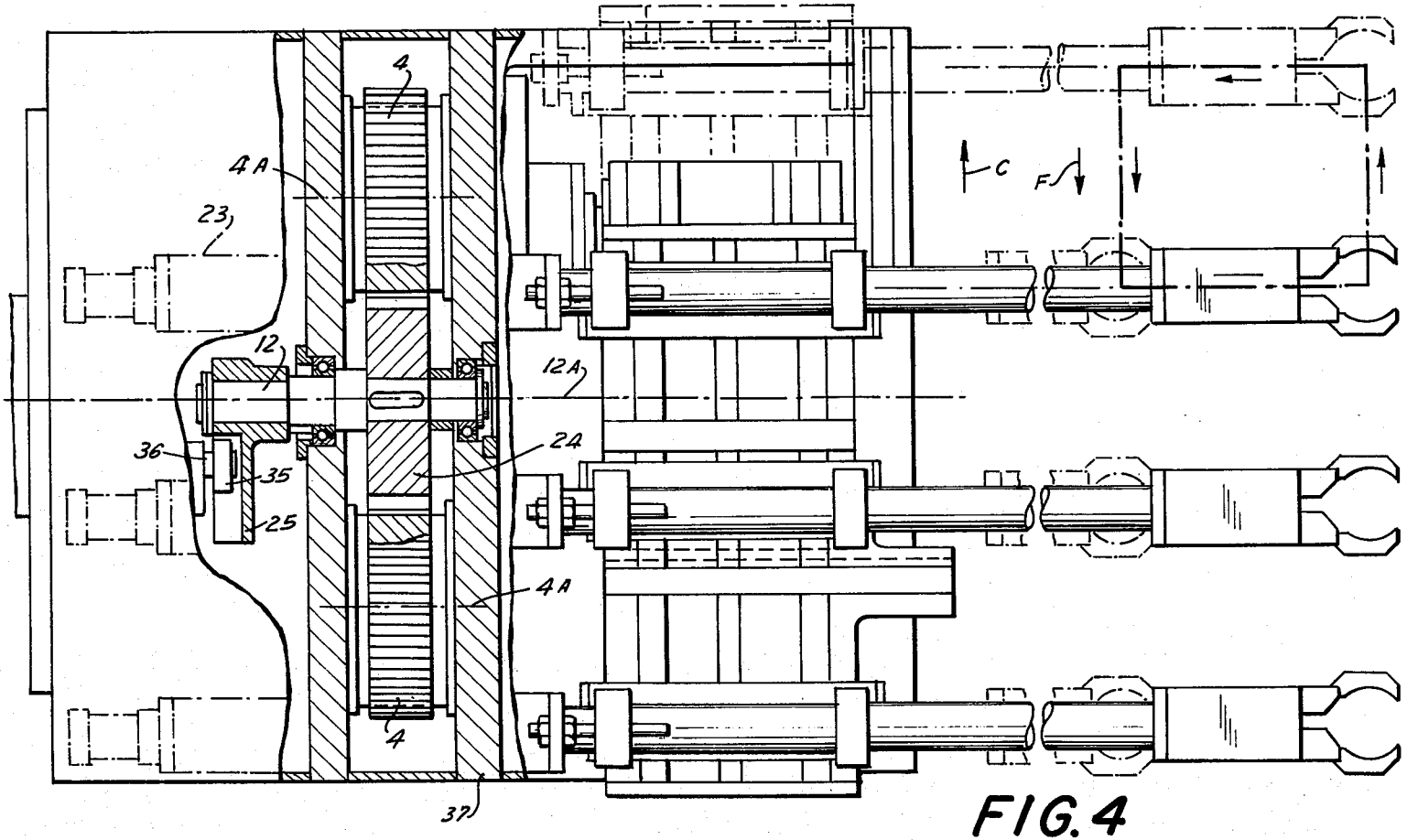

More particularly as shown in FIGS. 2-4 the transmission 11 is coupled to a first epicyclic transmission 13 coupled to a pair of third epicyclic transmissions 26 having crank outputs 5 carrying a main support or carriage 6. This carriage 6 in turn supports a traversing carriage 27 connected via a spindle 15 to a lifting carriage or slide 17 in turn supporting a manipulator slide 20 carrying the three tongs 7.

The carriage 6 can move up and down in the directions of arrows A and B respectively and from side to side perpendicular to the directions A and B in directions C and D. The slide 27 can move relative to the carriage 6 in the direction C and D but moves vertically in the direction A and B jointly with the carriage 6. The lifting carriage or slide 17 moves in the directions C and D horizontally jointly with the traversing carriage 27, but can move in directions A and B relative to the traversing slide 27. Finally the slide 20 moves in the directions A-D jointly with the lifting slide 17, but can itself move relative to this lifting slide 17 in a forward direction E and a backward direction F perpendicular to the directions A-D.

The manipulator tongs 7 serve to advance three workpieces stepwise through the stations 8. To this end these tongs 7 must reach into the press 3, each grab a respective workpiece 1, each lift the workpiece, travel horizontally with the lifted workpieces to the next stations, lower the workpieces down when these next stations are reached, release the workpieces and retract, and then return to the starting position. Thus in each cycle the workpieces will be stepped through the forging press, with appropriate loading and unloading tools provided at the end of the row of dies constituting the tools 8.

More particularly the transmission 11 has an output shaft 29 carrying a pinion 30 that meshes with a large-diameter gear 31 rotatable in the housing 37 about a horizontal axis 31A extending parallel to the directions E and F. This gear 31 carries offset from its axis 31A an eccentric pin 32 defining an eccentric axis 32A and carrying at one end a small pinion 33 meshing with a gear 34 fixed on the housing 37 and centered on the axis 31A. The gear 33 has exactly half as many teeth as the gear 34 so that a 2:1 ratio is formed between the two. The other end of the eccentric pin 32 carries an offset crank pin 36 defining an eccentric axis 36A and carrying centered on this axis 36A a roller 35.

Figure 5:
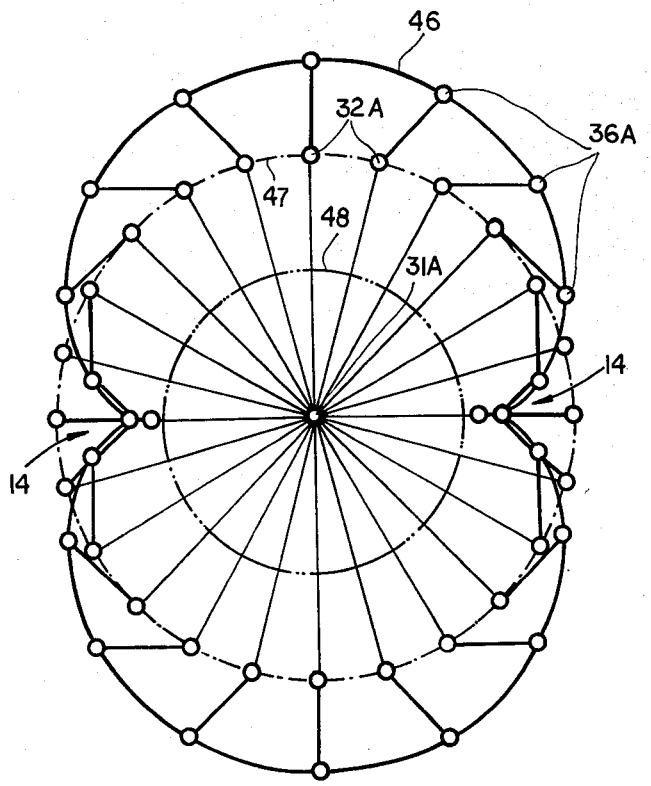
FIGS. 5 and 6 are diagrams illustrating the operation of two of the transmissions of the apparatus according to this invention.

The shaft 29 is constantly driven at a constant speed so that the axis 32A of the pin 32 describes a circle shown in FIG. 5 at 47. The 2:1 ratio between the gears 32 and 34 will cause the axis 36A to describe with respect to this circle 47 a pair of epicycloids formed on an imaginary circle 48 centered on the axis 31A and basically constituted by the pitch circle of the gear 34. The path 46 described by the axis 36A will therefore have two cusps 14 each constituting a location at which the axis 36A virtually does not move angularly relative to the axis 31A. Thus this epicyclic transmission 13 will produce relative to the axis 31A an angular displacement of the roller 35 which comes gradually and sinusoidally to a complete halt twice for each rotation of the gear 31, and which similarly accelerates from this halt at the locations 14 gradually and sinusoidally. The region 14 of halt or stopping has an arc length equal to approximately 20° relative to the axis 31A.

The roller 35 engages in a drive arm 25 carried on a shaft 12 defining an axis 12A coaxial with the axis 31A and carrying a drive pinion 24 (FIG. 4) forming the input gear of the two transmissions 26 having two main gears 4. In turn these gears 4 each rotate about an axis 4A, with the two axes 4A defining a plane including the axes 12A and 31A and extending in the directions E and F.

Each of the gears 4 carries a respective eccentric crank pin 5 defining an axis 5A which is parallel to and orbits about the respective axis 4A. Each pin 5 is rotatable in the respective gear 4 about its axis 5A and is formed on one end as a small-diameter pinion 38 meshing with a ring gear 39 fixed on the housing 37 and centered on the respective axis 4A. The gear 38 has one-fourth as many teeth as the gear 39 to produce a 4:1 ratio. At its other end each of the pins 5A is provided with a slightly offset crank pin 40 defining a respective axis 40A parallel to but offset slightly from the axis 5A.

Figure 6:
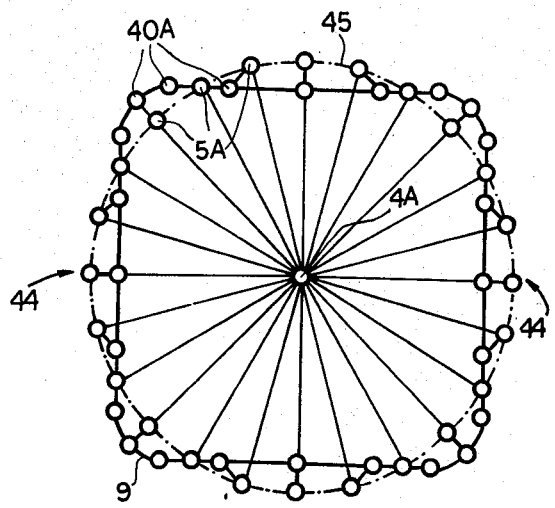

As shown in FIG. 6 the axes 5A of the transmission, 4 rotate about the respective, axes 4A to each form a circular orbit 45. The 4:1 ratio between the gears 38 and 39 causes the axis 48 to form relative to this circle 45 a figure 9 that is in effect four hypocycloids so that it has a rectangular shape, crossing the circle 45 at four locations. The generating circle for the hypocycloids constituting the rectangular figure 9 is the pitch circle of the gear 39.

It must be understood that the rectangular displacement shown in FIG. 6 merely represents the direction of movement of an element whose displacement speed is that shown in FIG. 5, so that at diametrically opposite locations 44 the pins 40 will draw to a complete halt, as the driving lever 25 for the transmissions 40 will not turn at all. This halt will be reached gradually in a sinusoidal manner and thereafter the pins 40 will speed up again afterward in a sinusoidal manner. The main support carriage 6 is mounted via bearings on these two pins 5 and follows the motion of these two pins 5 perfectly. Thus this carriage 6 is displaced in a generally rectangular path in directions A-D.

As shown in FIG. 3 a lever 28 is pivoted at a first pivot 28A on the main support slider carriage 6 and carries at its one end a roller 41 received in a vertically extending guide 42 on the transversing slide 27. The lever 28 has a movable pivot 28A' displaceable by means of a spindle 43 like the pivot 28A on a fixed support of the housing 37. The spindle 43 can be operated to longitudinally displace the lever 28 along its pivot 28A and fulcrum 28A' so as to increase the upper lever arm thereof. This lever 28 therefore multiplies the stroke of the carriage 6 so that the traversing slide 27 will move in the directions C and D relative to the carriages 6 by an extent determined by the length of the lever arms of this lever 28.

The traversing slide 27 is provided with a nut 16 threaded on the spindle 15 that carries at its upper end a pinion 22 engaged in a rack 21 extending in the directions E and F on the manipulator slide 20. The uppermost slide or lifting slide 17 can ride via rollers 18 on rails 19 of the housing 37. Hydraulic or pneumatic cylinders 23 open and close the tongs 7.

The arrangement of the spindle 15 serves to convert half of the vertical motion in the directions A and B of the carriage 27 into horizontal motion in the directions E and F. Thus in effect the rectangular figure 9 shown in FIG. 6 is folded along a diameter at the locations 44 (FIG. 6) corresponding to the stopping locations 14 (FIG. 5).

Figure 7:
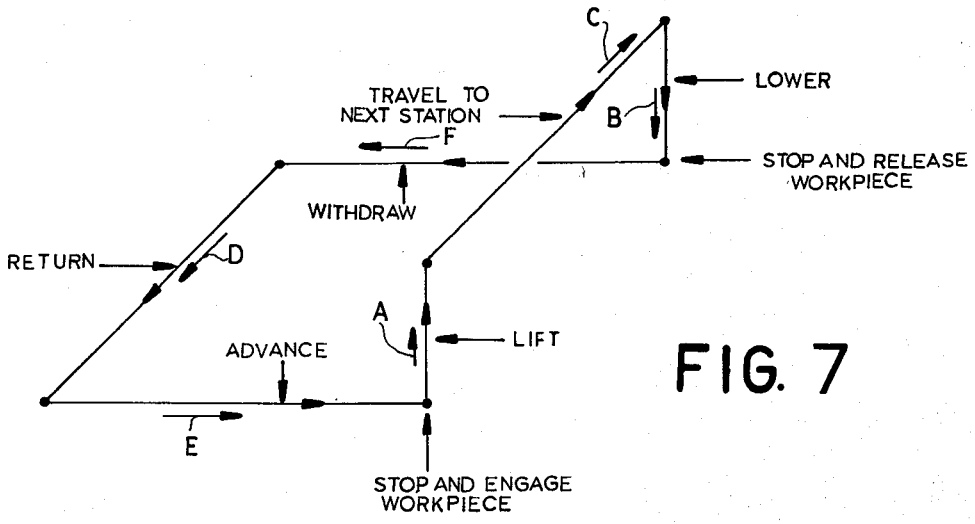
FIG. 7 is a motion diagram illustrating operation of the device according to the instant invention.

As described above the tongs 7 must follow a certain path of travel as illustrated in FIG. 7. The exact path traveled will be described below, then how the above-described mechanism effects such movement will be described in detail.

(a) First of all the tongs 7 must be advanced in direction E from the back position shown in solid lines in FIG. 2 to an advanced position shown in dot-dash lines in FIG. 2. At the end of this forward advance the tongs 7 come gradually to a halt and their cylinders 23 close them on the respective workpieces 1.

(b) Each of the tongs 7 then lifts in the direction A to pick the respective workpiece 1 up out of the respective working station 2.

(c) The tongs 7 then travel in the direction C through a horizontal step equal to the distance between stations 2.

(d) The tongs 2 all then lower, depositing their workpieces 1 each in the next station 2 and all coming gradually to a complete stop, at which point the cylinders 23 are actuated by reed switches or the like to open and release the workpieces 1.

(e) The tongs 7 all then withdraw in the direction F to the back position.

(f) All of the tongs 7 then return in the direction D to the starting position.

It is apparent how the rectangular motion is imparted to the carriage 6. This motion will stop in the middle of each upward stroke and in the middle of each downward stroke as a result of the stopping of all angular displacement of the roller 35 about the axis 12A.

The above-described "folding" of this rectangular figure 9 is achieved in that the lifting slide or carriage 17 only moves vertically jointly with the carriage 27 through the upper half of its stroke. Thus assuming that the parts are in the positions as shown in FIG. 2, the carriage 27 will rise vertically up in the direction A underneath the carriage or slide 17 without lifting this slide 17. This will have the effect of screwing the steep-threaded spindle 15 inside the nut 16 of the carriage 17, thereby rotating this spindle 15 about its vertical axis 15A and thereby rotating the pinion 22. As this pinion 22 is meshed with the rack 21 on the slide 20, the effect is to convert the first half of the upward motion of the carriage 27 into a forward motion of the carriage 20 in the direction E. After approximately half the upward travel in the direction A of the carriage 27 the nut 16 and other structure will engage underneath corresponding structure on the slide 17. This moment of engagement corresponds, in practice, to the moment at which the displacement stops altogether, as the axis 36A traverses the cusps or stop location 14. This moment also corresponds with the moment at which a controller closes the tongs 7 by means of the cylinders 23.

After stoppng of the carriage 27 gradually accelerates and continues its vertical displacement, this time the two carriages 27 and 17, as well as the carriage 20, all moving vertically jointly to achieve the lifting action described above at subparagraph b). At the top of this motion the horizontal component in direction C will be effected by the carriages 27, 17 and 20 synchronously in accordance with the setting of the arm of lever 28 with the carriage 6.

At the end of the horizontal travel in direction C the carriage 27 will again lower in direction D. During the first half of this downward stroke the carriages 27, 17 and 20 will move vertically jointly. At the bottom end of the first half of the stroke, however, the device will again come momentarily to a halt so that the tongs 7 can open. At this instant the rollers 18 will engage on the rails 19. Subsequent further downward displacement of the carriage 27 will again rotate the spindle 15 so as to drive the carriage 20 backwardly in the direction F.

Subsequent return in direction D is effected jointly by the carriages 27, 17 and 20. The length of this horizontal stroke is determined, as mentioned above, by the setting of the spindle 43 of the lever 28.

Thus with a relatively compact mechanism an exactly controlled and mechanically sure displacement of the tongs in three mutually orthogonal directions is ensured. The use of constant-mesh gearing throughout along with epicyclic gear trains ensures smooth stopping and starting at the locations at which the workpiece must be grasped and released, and otherwise ensures smooth direction changes with virtually no jarring of the machinery or shock to any of its components. What is more the use of such gearing allows relatively heavy workpieces 1 to be handled with ease, as the load-transmitting capacity of such transmissions is very great.

I claim:

1. A workpiece manipulator comprising: first transmission means including a first epicyclic gear train having a rotary input and a crank output for movement of said output generally in a planar and square path on rotation of said rotary input through a predetermined angular distance, said path having generally parallel first and second sides and generally parallel third and fourth sides interconnecting said first and second sides and forming therewith a plane;

drive means including a second epicyclic gear train connected to said rotary input for rotating same at a speed increasing generally from a standstill to a predetermined speed then slowing generally to a standstill twice for each travel of said output about said square path, said standstills respectively corresponding to intermediate positions of said output along said first and second sides;

a traversing carriage coupled to said crank output and generally jointly displaceable therewith in said plane in a first direction generally parallel to said first and second sides and in a second direction generally parallel to said third and fourth sides;

a lift carriage coupled to said traversing carriage and jointly displaceable therewith in said second direction;

a holder carriage coupled to said lift carriage and jointly displaceable therewith in said first and second directions but independently displaceable relative thereto in a third direction generally perpendicular to said first and second directions;

an openable and closable workpiece holder carried on said holder carriage;

a threaded spindle extending generally in said first direction, threaded into said traversing carriage, carrying at said holder carriage a pinion, and nondisplaceable in said first direction relative to said lift carriage;

a rack fixed on said holder carriage, extending in said third direction, and in mesh with said pinion; and means for preventing said lift carriage from moving jointly in said first direction of displacement of said crank output between said intermediate positions and said fourth side for screwing of said spindle in said traversing carriage to rotate said pinion and displace said holder carriage in said third direction.

2. The manipulator defined in claim 1 wherein said first direction is upright and said second and third directions are horizontal.

3. The manipulator defined in claim 1 wherein said first epicyclic gear train includes two main gears each having a respective such crank output both connected to said traversing carriage, a common input gear meshing with both of said main gears, and a crank arm connected to said second epicyclic gear train and rotationally fixed to said input gear.

4. A workpiece manipulator comprising:

first transmission means having a rotary input and an output for movement of said output generally in a planar and square path on rotation of said rotary input through a predetermined angular instance, said path having generally parallel first and second sides and generally parallel third and fourth sides interconnecting said first and second sides and forming a plane therewith;

drive means connected to said rotary input for rotating same at a speed increasing generally from a standstill to a predetermined speed then slowing generally to a standstill twice for each travel of said output about said square path, said standstills respectively corresponding to intermediate positions of said output along said first and second sides;

a workpiece holder; and second transmission means connected between said output and said holder for joint displacement of said holder and said output during travel of said output along said third and fourth sides and during travel along those portions of said first and second sides between said third side and said intermediate positions, and for displacement of said holder in a direction generally perpendicular to said plane of said sides during travel of said output along those portions of said first and second sides between said fourth side and said intermediate positions.

5. The apparatus defined in claim 4 wherein said drive means includes an epicyclic gear train for sinusoidally increasing and decreasing said speed.

6. The manipulator defined in claim 5 wherein said first transmission means includes another epicyclic gear train having a crank connected to said second transmission means.

7. The manipulator defined in claim 6 wherein said second transmission means includes:

a first carriage connected to said crank and displaceable substantially only in said plane thereby;

a second carriage connected to said first carriage and displaceable in said plane;

a third carriage connected to said second carriage and displaceable in and generally perpendicular to said plane;

a threaded spindle extending generally parallel to said first and second sides, threaded into said first carriage, carrying at said third carriage a pinion, and nondisplaceable in a direction parallel to said first and second sides relative to said second carriage;

a rack fixed on said third carriage, extending generally perpendicular to said plane, and in mesh with said pinion;

means for preventing said second carriage from moving jointly in said direction parallel to said first and second sides during displacement of said output between said intermediate positions and said fourth side for screwing of said spindle in said first carriage to rotate said pinion and displace said third carriage perpendicular to said plane.

* * * * *